US008674623B2

(12) United States Patent
Yang

(10) Patent No.: US 8,674,623 B2
(45) Date of Patent: Mar. 18, 2014

(54) LED DEVICE WITH VOLTAGE-LIMITING UNIT AND SHUNT CURRENT-LIMITING RESISTANCE

(76) Inventor: Tai-Her Yang, Dzan-Hwa (TW)

( * ) Notice: Subject to any disclaimer, the term of this patent is extended or adjusted under 35 U.S.C. 154(b) by 332 days.

(21) Appl. No.: 13/025,296

(22) Filed: Feb. 11, 2011

(65) Prior Publication Data

US 2012/0206048 A1 Aug. 16, 2012

(51) Int. Cl.
*H05B 37/02* (2006.01)

(52) U.S. Cl.
USPC ..... 315/306; 315/185 R

(58) Field of Classification Search
USPC ..... 315/185 R, 291, 299, 300, 306, 310
See application file for complete search history.

(56) References Cited

U.S. PATENT DOCUMENTS

| | | | | |
|---|---|---|---|---|
| 3,967,257 | A * | 6/1976 | Hager | 340/664 |
| 6,650,064 | B2 * | 11/2003 | Guthrie et al. | 315/185 R |
| 7,157,859 | B2 * | 1/2007 | Inoue | 315/185 R |
| 7,671,541 | B2 * | 3/2010 | Hickey | 315/307 |
| 2002/0043943 | A1 * | 4/2002 | Menzer et al. | 315/291 |
| 2009/0289561 | A1 * | 11/2009 | Chen | 315/185 S |
| 2010/0207533 | A1 * | 8/2010 | Chang et al. | 315/185 R |

* cited by examiner

*Primary Examiner* — Thuy Vinh Tran
(74) *Attorney, Agent, or Firm* — Bacon & Thomas, PLLC

(57) ABSTRACT

The present invention provides a LED device with the voltage-limiting unit and the shunt current-limiting resistance wherein a voltage-limiting unit is connected in series with a current-limiting resistance then connected in parallel with two ends of a LED, so that to constitute the light-emitting unit, thereby when plural of the light-emitting units are connected in series (including connected in series and parallel), the current of LED loaded with higher end voltage passing through the voltage-limiting unit is prevented to be overly high when subject to abnormal high voltage.

4 Claims, 2 Drawing Sheets

LED DEVICE WITH VOLTAGE-LIMITING UNIT AND SHUNT CURRENT-LIMITING RESISTANCE

BACKGROUND OF THE INVENTION (a) Field of the Invention

According to the present invention, hereinafter the term "LED" is the abbreviation of the light-emitting diode.

The present invention relates to a LED device with voltage-limiting unit and shunt current-limiting resistance in which a voltage-limiting unit is connected in series with a current-limiting resistance then connected in parallel with two ends of a LED for limiting the shunt current passing through the voltage-limiting unit.

(b) Description of the Prior Art

Conventional LEDs usually parallel connect with the voltage-limiting units at two ends of each LED, such as the zener diode, to constitute the light-emitting unit, thereby when the end voltage of LED is abnormally increased, the abnormal voltage is absorbed by the zener diode; however, when the light-emitting units being parallel connected by the above mentioned LED and the zener diode are series connected (including series-parallel connected) in plural sets to constitute the light-emitting unit, the voltage is not able to be evenly distributed due to the different properties of the LED and the zener diode, so that when subject to abnormal high voltage, the LED loaded with higher end voltage is passed by the higher current therefore the LED is often damaged.

SUMMARY OF THE INVENTION

The present invention provides a LED device with the voltage-limiting unit and the shunt current-limiting resistance wherein a voltage-limiting unit is connected in series with a current-limiting resistance then connected in parallel with two ends of a LED, so that to constitute the light-emitting unit, thereby when plural of the light-emitting units are connected in series (including connected in series and parallel), the current of LED loaded with higher end voltage passing through the voltage-limiting unit is prevented to be overly high when subject to abnormal high voltage.

BRIEF DESCRIPTION OF THE DRAWINGS

The present invention will be apparent to those skilled in the art by reading the following detailed description of a preferred embodiment thereof, with reference to the attached drawings, in which.

DESCRIPTION OF MAIN COMPONENT SYMBOLS

101: LED Light-emitting diode
105: Voltage-limiting unit
106: Diode
111: Current-limiting resistance

DETAILED DESCRIPTION OF THE PREFERRED EMBODIMENT

Conventional LEDs usually parallel connect with the voltage-limiting units at two ends of each LED, such as the zener diode, to constitute the light-emitting unit, thereby when the end voltage of LED is abnormally increased, the abnormal voltage is absorbed by the zener diode; however, when the light-emitting units being parallel connected by the above mentioned LED and the zener diode are series connected (including series-parallel connected) in plural sets to constitute the light-emitting unit, the voltage is not able to be evenly distributed due to the different properties of the LED and the zener diode, so that when subject to abnormal high voltage, the LED loaded with higher end voltage is passed by the higher current therefore the LED is often damaged.

The present invention provides a LED device with voltage-limiting unit and shunt current-limiting resistance in which a LED is connected in parallel with a voltage-limiting unit, and a current-limiting resistance is connected in series between the LED and the voltage-limiting unit for limiting the shunt current passing through the voltage-limiting unit.

Figure 1:
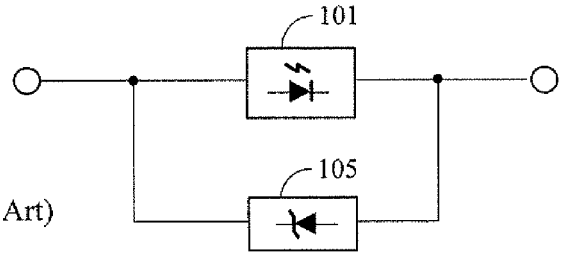
FIG. 1 (Prior Art)
FIG. 1 is a circuit schematic diagram showing that a conventional light-emitting unit is constituted by a LED connected in parallel with a voltage-limiting unit.

Referring to FIG. 1, which is a circuit schematic diagram showing that a conventional light-emitting unit is constituted by a LED being connected in parallel with a voltage-limiting unit;

As shown in FIG. 1, a light-emitting unit is constituted by a LED being connected in parallel with a zener diode.

Figure 2:
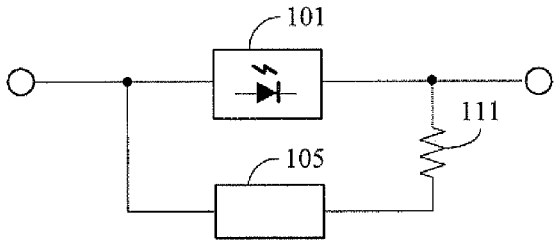
FIG. 2 is a circuit schematic diagram showing that a light-emitting unit is constituted by a voltage-limiting unit being connected in series with a current-limiting resistance then connected in parallel with two ends of a LED, according to the present invention.

Referring to FIG. 2, which is a circuit schematic diagram showing that a light-emitting unit is constituted by a voltage-limiting unit being connected in series with a current-limiting resistance then connected in parallel with two ends of a LED, according to the present invention;

As shown in FIG. 2, it mainly consists of:

LED (101): constituted by the light emitting diode;

Voltage-limiting unit (105): constituted by a semiconductor unit, e.g. a zener diode or a varistor, with a property of the resistance thereof being rapidly dropped when subject to overvoltage;

Current-limiting resistance (111): constituted by a resistive unit and served to be installed between the LED (101) and the voltage-limiting unit (105);

Wherein a light-emitting unit is structured through series-connecting the voltage-limiting unit (105) with the current-limiting resistance (111) then parallel-connecting with two ends of the LED (101).

Figure 3:
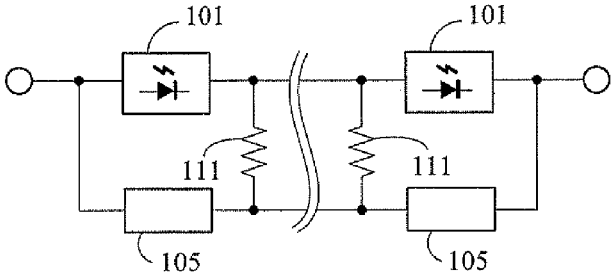
FIG. 3 is a circuit schematic diagram showing that two or more than two of the light-emitting units as shown in FIG. 2 are series-connected or series-parallel connected in the same polarity to constitute the light-emitting unit set.

Referring to FIG. 3, which is a circuit schematic diagram showing that two or more than two of the light-emitting units as shown in FIG. 2 are series-connected or series-parallel connected in the same polarity to constitute the light-emitting unit set;

As shown in FIG. 3, it mainly consisted of:

LED (101): constituted by the light emitting diode;

Voltage-limiting unit (105): constituted by a semiconductor unit, e.g. a zener diode or a varistor, with a property of the resistance thereof being rapidly dropped when subject to overvoltage;

Current-limiting resistance (111): constituted by a resistive unit and served to be installed between the LED (101) and the voltage-limiting unit (105);

Wherein a light-emitting unit is structured through series-connecting the voltage-limiting unit (105) with the current-limiting resistance (111) then parallel-connecting with two ends of the LED (101);

A light-emitting unit set is structured through series-connecting or series-parallel connecting two or more than two of the mentioned light-emitting units in the same polarity.

Figure 4:
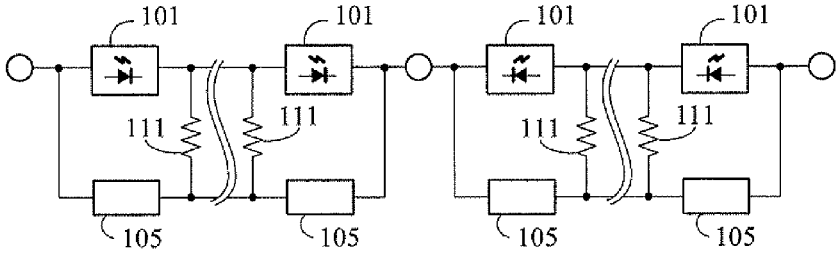
FIG. 4 is an applied circuit schematic diagram showing that two or more than two of the light-emitting unit sets as shown in FIG. 3 are connected in series in the reverse polarity.

Referring to FIG. 4, which is an applied circuit schematic diagram showing that two or more than two of the light-emitting unit sets as shown in FIG. 3 are connected in series in the reverse polarity;

As shown in FIG. 4, it mainly consists of:

LED (101): constituted by the light emitting diode;

Voltage-limiting unit (105): constituted by a semiconductor unit, e.g. a zener diode or a varistor, with a property of the resistance thereof being rapidly dropped when subject to overvoltage;

Current-limiting resistance (111): constituted by a resistive unit and served to be installed between the LED (101) and the voltage-limiting unit (105);

Wherein a light-emitting unit is structured through series-connecting the voltage-limiting unit (105) with the current-limiting resistance (111) then parallel-connecting with two ends of the LED (101);

A light-emitting unit set is structured through series-connecting or series-parallel connecting two or more than two of the mentioned light-emitting units in the same polarity;

The LED device is structured through series-connecting two or more than two sets of mentioned light-emitting unit sets in the reverse polarity.

Figure 5:
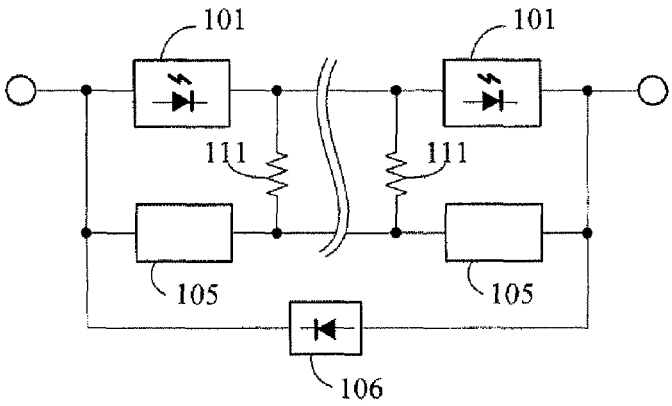
FIG. 5 is an applied circuit schematic diagram showing that two ends of the light-emitting unit set as shown in FIG. 3 are connected in parallel in the reverse polarity with a diode.

Referring to FIG. 5, which is an applied circuit schematic diagram showing that two ends of the light-emitting unit set as shown in FIG. 3 are connected in parallel in the reverse polarity with a diode;

As shown in FIG. 5, it mainly consisted of:

LED (101): constituted by the light emitting diode;

Voltage-limiting unit (105): constituted by a semiconductor unit, e.g. a zener diode or a varistor, with a property of the resistance thereof being rapidly dropped when subject to overvoltage;

Current-limiting resistance (111): constituted by a resistive unit and served to be installed between the LED (101) and the voltage-limiting unit (105);

Wherein a light-emitting unit is structured through series-connecting the voltage-limiting unit (105) with the current-limiting resistance (111) then parallel-connecting with two ends of the LED (101);

A light-emitting unit set is structured through series-connecting or series-parallel connecting two or more than two of the mentioned light-emitting units in the same polarity;

Two ends of the mentioned light-emitting unit sets, which are series connected in the same polarity, are connected in parallel in the reverse polarity with a diode (106).

Figure 6:
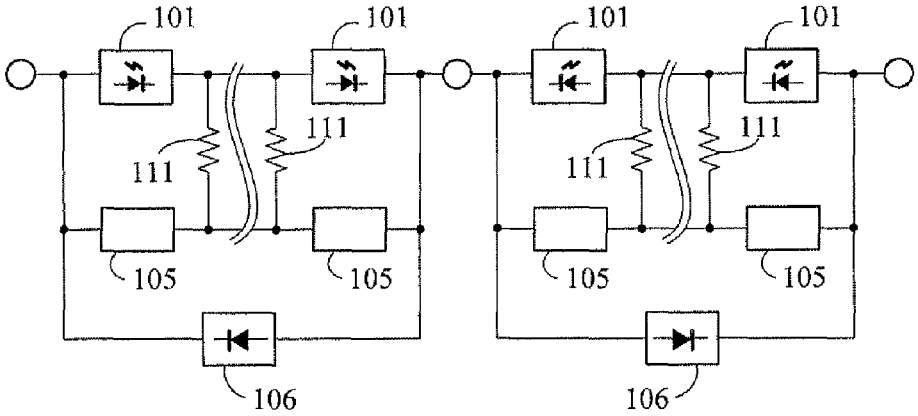
FIG. 6 is an applied circuit schematic diagram showing that two ends of the reverse-polarity series light-emitting unit sets as shown in FIG. 4 are respectively connected in parallel in the reverse polarity with a diode.

Referring to FIG. 6, which is an applied circuit schematic diagram showing that two ends of the reverse-polarity series light-emitting unit sets as shown in FIG. 4 are respectively connected in parallel in the reverse polarity with a diode;

As shown in FIG. 6, it mainly consists of:

LED (101): constituted by the light emitting diode;

Voltage-limiting unit (105): constituted by a semiconductor unit, e.g. a zener diode or a varistor, with a property of the resistance thereof being rapidly dropped when subject to overvoltage;

Current-limiting resistance (111): constituted by a resistive unit and served to be installed between the LED (101) and the voltage-limiting unit (105);

Wherein a light-emitting unit is structured through series-connecting the voltage-limiting unit (105) with the current-limiting resistance (111) then parallel-connecting with two ends of the LED (101);

A light-emitting unit set is structured through series-connecting or series-parallel connecting two or more than two of the mentioned light-emitting units in the same polarity;

Two or more than two of the mentioned light-emitting unit sets are further connected in series in the reverse polarity;

In the mentioned light-emitting unit sets of different polarity sides, which are connected in series in the reverse polarity, two ends of the plural series-connected or series-parallel connected light-emitting unit sets in the same polarity are respectively connected in parallel in the reverse polarity with a diode (106).

According to the LED device with voltage-limiting unit and shunt current-limiting resistance of the present invention, the mentioned LED (101) can not only be structured with a single LED (101), but two or more than two LEDs (101) can be provided for structuring a LED unit through connecting the LEDs in series, in parallel or in series and parallel to replace the single LED (101).

According to the LED device with voltage-limiting unit and shunt current-limiting resistance of the present invention, the voltage-limiting protective unit consists one or more than more of the following units, wherein one or more than one units being in same-polarity series, parallel or series and parallel connection, which include:

zener diode;

varistor;

diode with property of forward voltage drop;

zener diode with property of reverse-polarity forward voltage drop.

According to the present invention, the power source for the provided LED device can be a constant-current power source or constant-voltage power source, or a current-limiting power source or voltage-limiting power source, or a power source wherein voltage and current not being particularly controlled; for cooperating the operation of the voltage-limiting unit of the present invention, an internal impedance at an output end of the power source or an impedance unit between the output end of the power source and the loading can be further provided, so when the voltage of the power source is altered, the current passing through the voltage-limiting unit generates a voltage drop at the two ends of the impedance unit, and a voltage regulation effect is provided to the voltage at the two ends of the LED device of the present invention.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

The invention claimed is:

1. A light-emitting unit set comprising at least two light emitting diodes (LED) devices, each of said LED devices consisting of:

a voltage-limiting unit (105), said voltage-limiting unit being a semiconductor unit configured in a way such that a resistance of the semiconductor unit rapidly drops when subject to overvoltage;

at least one light emitting diode (LED) (101) having two ends; and a shunt current-limiting resistance unit (111), said shunt current-limiting resistance unit (111) being a resistive unit and installed between the at least one LED (101) and the voltage-limiting unit (105), wherein the voltage-limiting unit (105) is connected in series with the currentlimiting resistance unit (111) then connected in parallel with the two ends of the at least one LED (101) , wherein said at least two LED devices (101) are series-connected or series-parallel connected in a same polarity, and wherein two ends of the light-emitting unit set are connected in parallel in a reverse polarity with a diode.

2. A light-emitting unit comprising at least two light-emitting unit sets, each of said light-emitting unit sets comprising at least two light emitting diodes (LED) devices, each of said LED devices consisting of:

a voltage-limiting unit (105), said voltage-limiting unit being a semiconductor unit configured in a way such that a resistance of the semiconductor unit rapidly drops when subject to overvoltage;

at least one light emitting diode (LED) (101) having two ends; and a shunt current-limiting resistance unit (111), said shunt current-limiting resistance unit being a resistive unit and installed between the at least one LED and the voltage-limiting unit, wherein the voltage-limiting unit (105) is connected in series with the currentlimiting resistance unit (111) then connected in parallel with the two ends of the at least one LED, wherein said at least two LED devices are series-connected or series-parallel connected in a same polarity, wherein said at least two light-emitting unit sets are connected in series in a reverse polarity, and wherein two ends of the at least two reverse-polarity series-connected light-emitting unit sets are respectively connected in parallel in the reverse polarity with a diode.

3. The light emitting unit or light emitting unit set according to claim 2, wherein the at least one LED comprises two or more LEDs, wherein the two or more LEDs are connected in series, in parallel or in series and parallel.

4. The light emitting unit or light emitting unit set according to claim 2, wherein the voltage-limiting unit is at least one unit selected from the group consisting of: a zener diode; a varistor; a diode with property of forward voltage drop; and a zener diode with property of reverse-polarity forward voltage drop, wherein the at least one unit is connected having a same-polarity series, parallel or series and parallel connection.

* * * * *